United States Patent [19]

Krans

[11] Patent Number: 4,644,889

[45] Date of Patent: Feb. 24, 1987

[54] SAILBOAT KEEL

[76] Inventor: Keith A. Krans, 5246 Xerxes Ave. South, Minneapolis, Minn. 55410

[21] Appl. No.: 769,417

[22] Filed: Aug. 26, 1985

[51] Int. Cl.[4] ..... B63B 3/38

[52] U.S. Cl. ..... 114/40; 244/130; 244/209

[58] Field of Search ..... 114/162, 140, 127, 141, 114/142, 39.2; 244/208, 210, 130, 209; 441/79

[56] References Cited

U.S. PATENT DOCUMENTS

| | | | |
|---|---|---|---|
| 59,296 | 10/1866 | Wappich . | |
| 2,154,321 | 4/1939 | Briggs . | |
| 2,961,987 | 11/1960 | Mello . | |
| 3,080,845 | 3/1963 | Pollack | 114/140 |
| 3,435,654 | 4/1969 | Papst | 244/209 |
| 3,680,511 | 8/1972 | English . | |
| 3,688,726 | 9/1972 | Mitchell . | |
| 4,089,286 | 5/1978 | Scheel | 114/140 |
| 4,515,101 | 5/1985 | Akerblom | 114/140 |
| 4,537,143 | 8/1985 | Garde | 114/140 |

*Primary Examiner*—Galen L. Barefoot
*Assistant Examiner*—Edwin L. Swinehart
*Attorney, Agent, or Firm*—Orrin M. Haugen; Thomas J. Nikolai; Frederick W. Niebuhr

[57] ABSTRACT

A sailboat keel structure, wherein the keel has an elongated body with fore and aft edges, and a generally elliptical cross-section. An elongated slotted opening is formed along the aft edge between the upper and lower ends of the keel, with the opening extending forwardly to a point generally aft of the minor axis of the elliptically configured keel so as to create an internal chamber in the keel with an aftward opening. A plurality of bores are formed in the keel and extend diagonally from forward ports along the outer surface of the keel to aftward ports along the inner lateral surfaces of the internal chamber. While the bores may be generally cylindrical in their configuration, they are preferably tapered from a smaller diameter at the forward port to an increased diameter at the aftward port.

5 Claims, 6 Drawing Figures

SAILBOAT KEEL

BACKGROUND OF THE INVENTION

The present invention relates generally to a keel structure for use in sailboats, and more particularly to a keel structure which has improved hydrodynamic characteristics and properties.

Keels are requisite components of sailboats, and are utilized for the purposes of contributing to the forward motion of the sailboat, as well as to stability of the craft while underway. In order to provide the forward motion, the keel must present a relatively large profile or lateral surface to the water, with the area of the keel which is exposed or presented to the water being a factor in the force which the wind generates to provide forward motion for the craft. Because of their size, and necessary or essential cross-sectional dimension, a certain amount of resistance to forward motion is provided by the presence of the submerged keel.

The present invention provides a means for reducing the resistance to motion by reducing the amount of turbulence, eddies, and cavitation which would otherwise be created by the motion of the keel moving through the water. Keel structures are generally elliptical in cross-section, with the elliptical cross-section having been found in the past to provide a reduction in the turbulence, eddies and cavitation. In accordance with the present invention, however, an elongated slotted opening is formed along the aft edge of the keel and extends forwardly to a point aft of the minor axis of the elliptically configured body so as to create an internal chamber in the keel body. A plurality of bores are formed in the keel body and extend diagonally from forward ports along the outer surface of the keel to aftward ports along the inner surfaces of the internal chamber. It has been determined that the presence of the openings in the keel create a vacuum action with passage of water through the bores, thus reducing the creation of turbulence, generation of eddies, and cavitation in the water as the craft moves along its course.

SUMMARY OF THE INVENTION

Therefore, it is a primary object of the present invention to provide an improved sailboat keel structure with an elongated slotted opening being formed along the aft edge of the keel and communicating with the exterior of the keel through diagonally extending bores, with the improved keel structure reducing the drag otherwise imposed by the keel on the forward motion of the sailboat as it moves along its course.

It is a further object of the present invention to provide an improved keel structure which improves the flow of water therearound as the sailboat moves along its course, thereby improving the flow characteristics of water around the surface of the keel, through a reduction in the formation of eddies and a reduction in the creation of cavitation.

It is a further object of the present invention to provide an improved sailboat keel structure which is provided with means to accommodate a flow of water through the keel so as to reduce the formation of eddies, and reduce cavitation along the aft edge of the keel while the craft moves through the water.

DESCRIPTION OF THE PREFERRED EMBODIMENT

Figure 1:
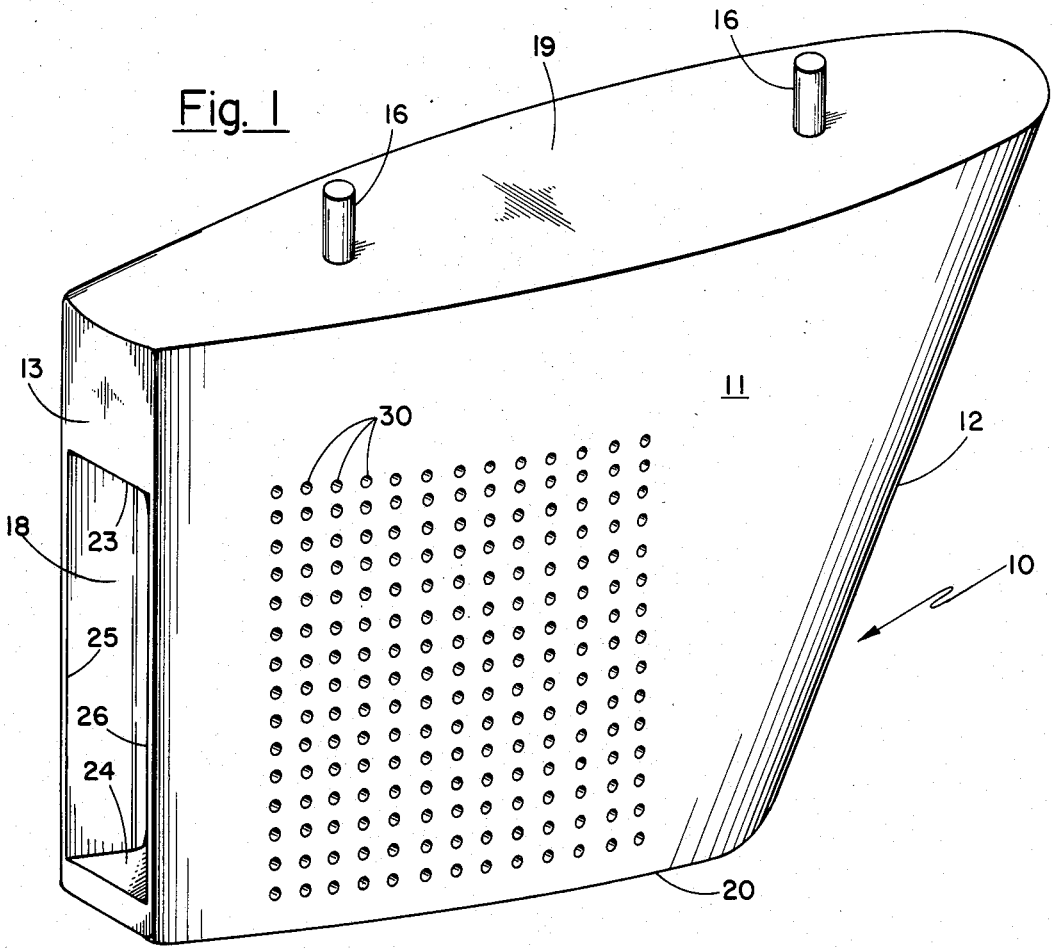
FIG. 1 is a perspective view of the improved sailboat keel structure of the present invention, and including attachment studs for securing the keel to the hull portion of a sailboat.
Figure 2:
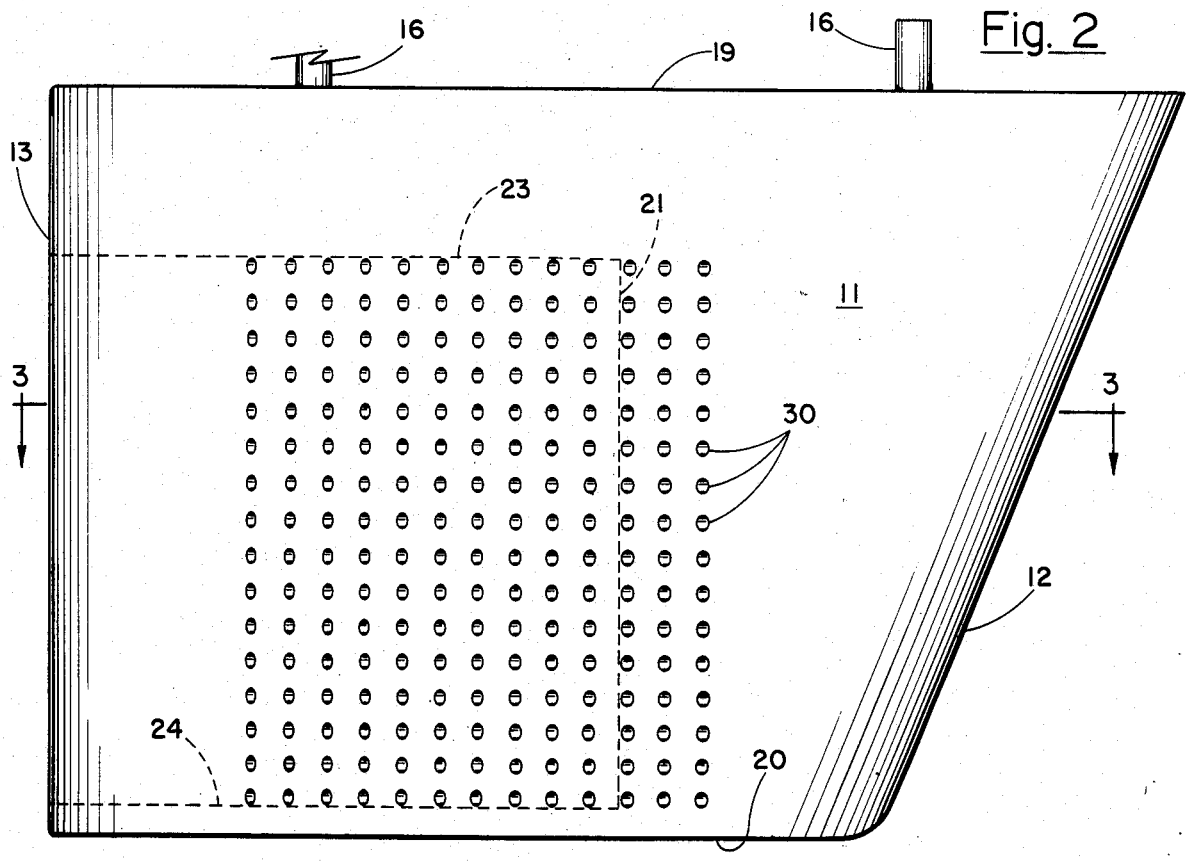
FIG. 2 is a side elevational view of the keel structure illustrated in FIG. 1.

In accordance with the preferred modification of the present invention, and with particular attention being directed to FIGS. 1 and 2 of the drawings, the sailboat keel structure generally designated 10 comprises an elongated body 11 with a fore edge 12 and an aft edge 13, with the body 11 having a generally elliptical cross-section with a major axis extending along the center line of the craft, and with the minor axis being generally transverse thereto.

Figure 6:
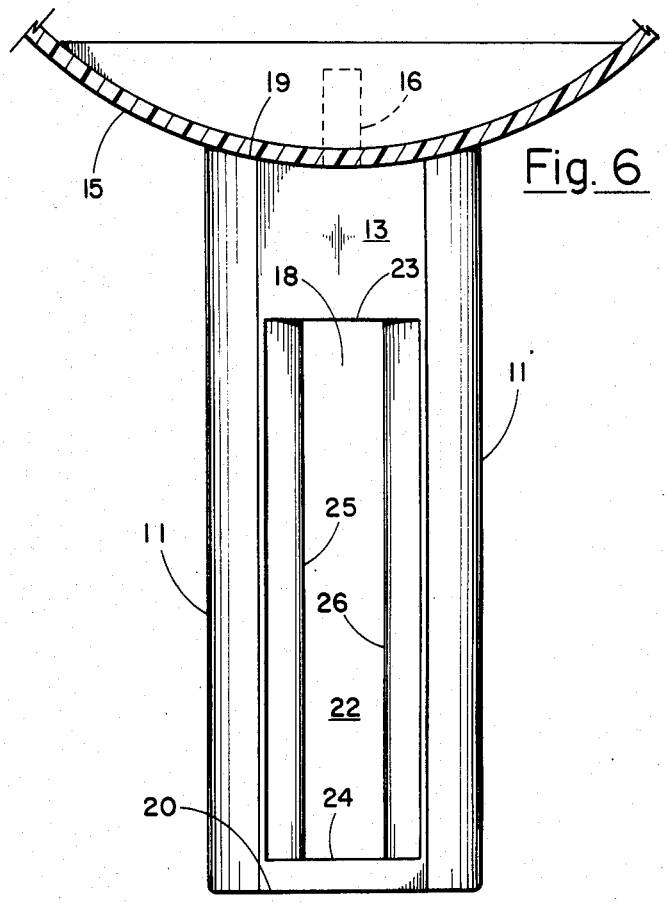
FIG. 6 is a rear elevational view of the keel structure illustrating the aft edge, and further illustrating, in section, a fragmentary portion of the hull to which the keel is attached.

The upper end of the keel structure is arranged to be secured to the hull of the sailboat, with a fragmentary portion of the hull being shown at 15 in FIG. 6. Conventional studs for securing the keel to the hull are illustrated at 16—16 in FIGS. 1 and 2.

An elongated slotted opening 18 is formed along the aft edge between the upper end 19 and lower end 20 of the keel body 11, with the slotted opening extending forwardly to a point generally aft of the minor axis of the elliptical cross-section of the body 11. As illustrated in phantom in FIG. 2, the slotted opening 18 extends forwardly to a forward wall 21, thereby creating and/or defining an internal chamber 22 within the keel body. The internal chamber 22 is further provided with an upper wall 23, a lower wall 24, and lateral walls 25 and 26.

Figure 3:
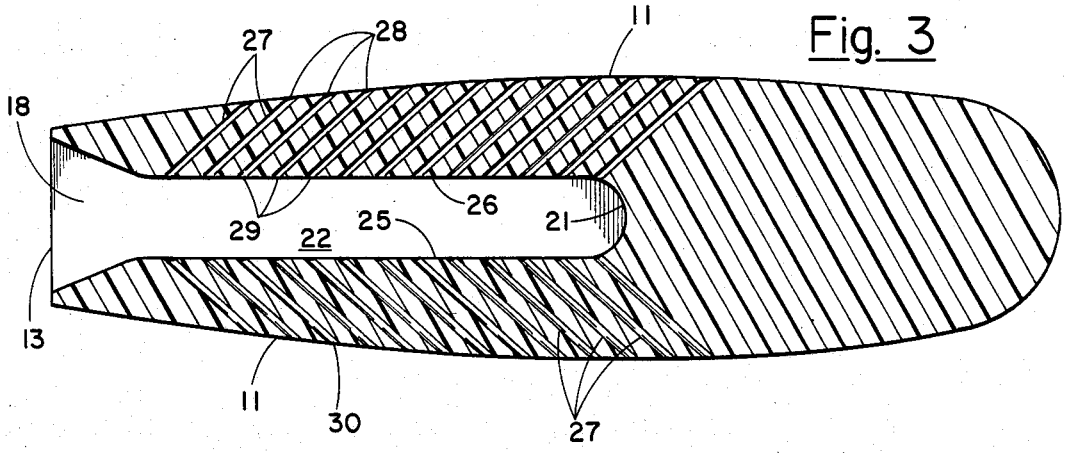
FIG. 3 is a horizontal sectional view taken along the line and in the direction of arrows 3—3 of FIG. 2.

A plurality of bores are formed in the keel body such as are shown at 27—27 in FIG. 3. These bores extend diagonally from forwardly disposed ports 28—28, to rearwardly disposed ports 29—29 communicating with the internal chamber 22. In the view of FIG. 3 of the drawings, these bores are shown as being of cylindrical configuration, it being understood and appreciated that these bores may be tapered from a somewhat smaller diameter at the forward portion thereof to a somewhat increased diameter at the aftward port thereof. By way of example, such a bore is illustrated at 30 in FIG. 3.

With attention being directed to FIG. 3 of the drawings, it will be observed that the bores 27—27 extend at an angle of approximately 45° from the center plane of the keel. It will be appreciated that these bores may be disposed at angles from approximately 30° to an angle less than 90° from the center plane of the keel. As indicated in FIG. 3, however, the angular disposition of approximately 45° appears preferable.

Figure 4:
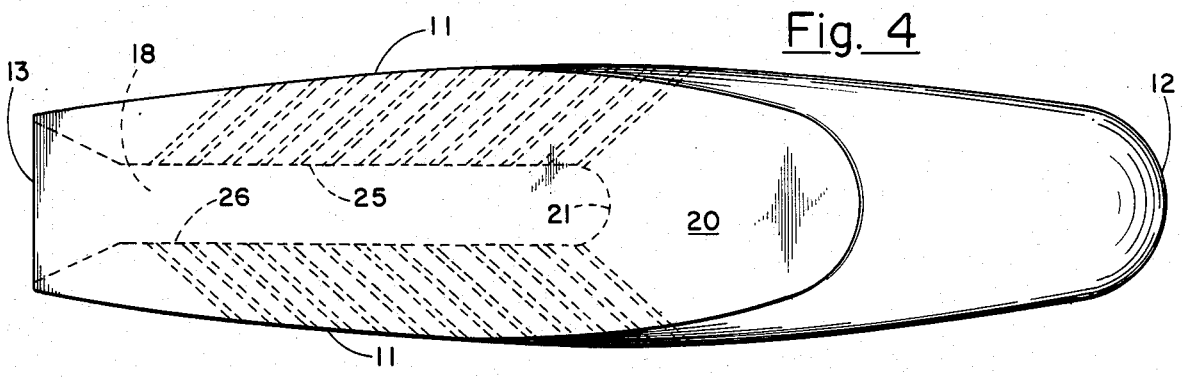
FIG. 4 is a bottom plan view of the sailboat keel structure as illustrated in FIGS. 1-3.
Figure 5:
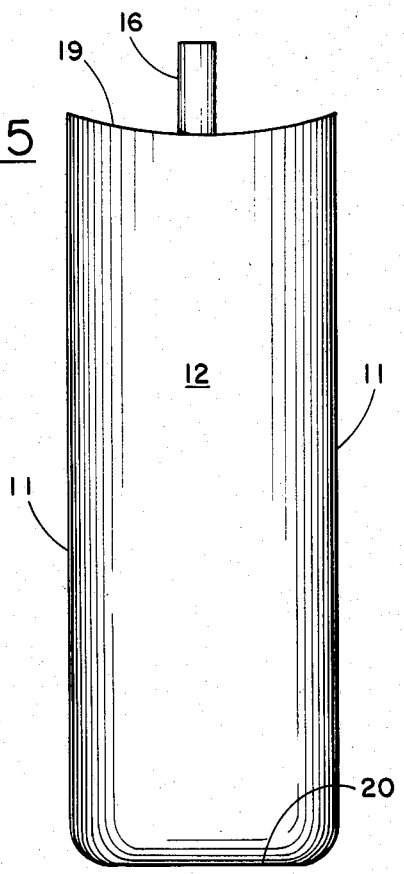
FIG. 5 is a front elevational view of the keel structure.

With continued attention being directed to FIGS. 3 and 4 of the drawings, it will be observed that the slotted opening 18 along the aft portion of the keel is tapered outwardly so as to widen the opening at the aft edge. Such an arrangement will, of course, reduce the resistance to the flow of fluid passing through internal chamber 22.

As an alternative to utilizing bores which are disposed along a relatively straight axis, it will be appreciated that the bores may be formed along an arcuate axis which hooks from the outer port to the inner port. In order to form such bores in the finished structure, individual sleeves may be pre-formed and cast-in-place in the keel structure at the desired points or positions.

Such an arrangement is effective in reducing turbulence, formation of eddies, and creation of cavitation along the keel while the sailboat in underway.

What is claimed is:

1. A sailboat keel including:

an elongated body generally symmetrical about a longitudinal center plane, said body having fore and aft edges and a generally elliptical cross-section taken transversely of said center plane;

an elongated internal chamber formed in said body between the upper and lower ends thereof, and extending forwardly to a point aft of a minor axis of said elliptical cross-section, said internal chamber having a pair of opposed lateral walls on opposite sides of said center plane, and open to the aft edge of said body;

a plurality of bores formed in said body and extending diagonally from forward ports along the outer surface of the body to aftward ports along said lateral walls of said internal chamber.

2. The sailboat keel of claim 1 wherein said bores are substantially cylindrical.

3. The sailboat keel of claim 1 wherein said bores are disposed along axes at an angle of at least about 30° from said center plane.

4. The sailboat keel of claim 3 wherein said bores are disposed along axes of an angle of about 45° from said center plane.

5. The sailboat keel of claim 1 wherein said lateral walls are tapered proximate the aft portion of said body to form an opening at said aft edge wider than the transverse distance between said lateral walls forwardly of said aft edge.

* * * * *